US012543833B2

(12) United States Patent
McKelvey et al.

(10) Patent No.: US 12,543,833 B2
(45) Date of Patent: Feb. 10, 2026

(54) LUGGAGE SYSTEM WITH CLOTHING RACK AND METHOD OF USE

(71) Applicants: Sanni McKelvey, Leawood, KS (US); Stephen R McKelvey, Leawood, KS (US)

(72) Inventors: Sanni McKelvey, Leawood, KS (US); Stephen R McKelvey, Leawood, KS (US)

( * ) Notice: Subject to any disclaimer, the term of this patent is extended or adjusted under 35 U.S.C. 154(b) by 89 days.

(21) Appl. No.: 18/538,690

(22) Filed: Dec. 13, 2023

(65) Prior Publication Data

US 2024/0108110 A1 Apr. 4, 2024

Related U.S. Application Data

(63) Continuation-in-part of application No. 17/537,915, filed on Nov. 30, 2021, now abandoned.

(60) Provisional application No. 63/119,415, filed on Nov. 30, 2020.

(51) Int. Cl.
*A45C 13/03* (2006.01)
*A45C 13/26* (2006.01)

(52) U.S. Cl.
CPC ..... *A45C 13/03* (2013.01); *A45C 2013/267* (2013.01)

(58) Field of Classification Search
CPC ..... A45C 5/03; A45C 5/14; A45C 2005/037; A45C 2013/267; A45C 13/03
USPC ..... 190/105
See application file for complete search history.

(56) References Cited

U.S. PATENT DOCUMENTS

| | | | |
|---|---|---|---|
| 139,420 | A | 5/1873 | Payne |
| 850,363 | A | 4/1907 | Frankel |
| 915,507 | A | 3/1909 | Thomas |
| 930,343 | A | 8/1909 | Bonsall |
| 2,639,793 | A | 5/1953 | Hellman |
| 3,144,946 | A | 8/1964 | Ellis |
| 3,819,282 | A | 6/1974 | Schultz |

(Continued)

FOREIGN PATENT DOCUMENTS

| | | | |
|---|---|---|---|
| AU | 2018101671 | 12/2018 | |
| AU | 2018101671 A4 * | 12/2018 | ..... A45C 13/28 |

(Continued)

OTHER PUBLICATIONS

"International Search Report and Written Opinion. PCT/US2021/061152".

*Primary Examiner* — Don M Anderson
*Assistant Examiner* — Justin Caudill
(74) *Attorney, Agent, or Firm* — AVEK IP, LLC

(57) ABSTRACT

A rigid piece of luggage with a pair of telescoping posts which suspend a clothing rack above the luggage. This allows the user to place wardrobe changes in an organized and ready-to-wear orientation for dance competitions, plays, or other events where the user needs quick access to clothing. This could also be used for regular travel for hanging clothes directly from the user's luggage. The telescoping pole has a base which snaps into receivers within the luggage and which then can be telescoped upward to suspend the clothing rack. A cover can seal the receiver when not in use. A button can be depressed or a latch slid away to release the telescoping arms, or the spring element could include that functionality itself. A curtain could be used with the clothing rack for privacy on-the-go.

10 Claims, 13 Drawing Sheets

(56) References Cited

U.S. PATENT DOCUMENTS

| | | | | |
|---|---|---|---|---|
| 4,245,763 | A | 1/1981 | Weinberg | |
| 4,267,905 | A | 5/1981 | Stewart | |
| 4,772,133 | A | 9/1988 | Volk | |
| 4,982,820 | A | 1/1991 | Scott | |
| 5,292,565 | A | 3/1994 | Napier et al. | |
| 5,306,063 | A | 4/1994 | Higgins et al. | |
| 5,379,870 | A | 1/1995 | Sadow | |
| 5,431,428 | A | 7/1995 | Marchwiak et al. | |
| 5,522,615 | A | 6/1996 | Kazmark, Jr. et al. | |
| 5,533,601 | A | 7/1996 | Wang | |
| 5,582,334 | A | 12/1996 | Blazer et al. | |
| 5,645,146 | A | 7/1997 | Bieber et al. | |
| 5,692,266 | A | 12/1997 | Tsai | |
| 5,782,325 | A | 7/1998 | O'Shea et al. | |
| 5,876,009 | A | 3/1999 | Simoncioni et al. | |
| 6,053,378 | A | 4/2000 | Doyel | |
| 6,119,835 | A | 9/2000 | Lin | |
| 6,129,254 | A | 10/2000 | Yu | |
| 6,161,253 | A | 12/2000 | Tu | |
| 6,182,981 | B1 | 2/2001 | Kuo | |
| D444,298 | S | 7/2001 | Starck | |
| 6,264,047 | B1 | 7/2001 | Crumley | |
| 6,338,180 | B1 | 1/2002 | Massard | |
| 6,481,574 | B1 | 11/2002 | Pakosh | |
| 6,575,493 | B1 | 6/2003 | Lowenstein | |
| 6,668,423 | B1 | 12/2003 | Chen | |
| D512,220 | S | 12/2005 | Van Himbeeck | |
| D532,970 | S | 12/2006 | Teitloff et al. | |
| 7,143,902 | B2 | 12/2006 | Iverson et al. | |
| 7,232,169 | B2 | 6/2007 | Porter | |
| 7,607,535 | B2 | 10/2009 | Jackson | |
| D648,928 | S | 11/2011 | Meersschaert et al. | |
| 8,123,007 | B2 | 2/2012 | Murdoch et al. | |
| 8,182,030 | B1 | 5/2012 | Britten | |
| 8,490,764 | B2 | 7/2013 | Simester | |
| 8,714,369 | B2 | 5/2014 | Liu et al. | |
| 9,101,187 | B2 | 8/2015 | Zheng | |
| 9,277,796 | B1 | 3/2016 | Elam | |
| D762,383 | S | 8/2016 | Sanz | |
| 9,622,597 | B2 | 4/2017 | White | |
| D793,728 | S | 8/2017 | Faibish et al. | |
| 9,820,542 | B2 | 11/2017 | McKelvey | |
| 10,271,644 | B1 | 4/2019 | Johnson | |
| 10,327,523 | B2 * | 6/2019 | Liang | A45C 5/14 |
| 10,383,415 | B1 | 8/2019 | Graham et al. | |
| D912,983 | S | 3/2021 | Newson | |
| D964,030 | S | 9/2022 | Thibadeau et al. | |
| 2001/0022257 | A1 | 9/2001 | Sadow | |
| 2004/0108345 | A1 | 6/2004 | Oh | |
| 2005/0286014 | A1 | 12/2005 | Chao | |
| 2006/0076861 | A1 | 4/2006 | Baughman | |
| 2006/0249550 | A1 | 11/2006 | Giampavolo | |
| 2007/0089952 | A1 | 4/2007 | Herbst et al. | |
| 2007/0256994 | A1 | 11/2007 | Jackson | |
| 2007/0295570 | A1 | 12/2007 | Campbell et al. | |
| 2009/0000084 | A1 | 1/2009 | Middup | |
| 2009/0000894 | A1 | 1/2009 | Middup | |
| 2009/0321204 | A1 | 12/2009 | Barkow | |
| 2010/0038198 | A1 * | 2/2010 | Jarvis | A45C 5/14 190/18 A |
| 2011/0120826 | A1 | 5/2011 | Middup | |
| 2011/0186396 | A1 | 8/2011 | Sheikh | |
| 2013/0175130 | A1 | 7/2013 | Liang | |
| 2016/0022032 | A1 | 1/2016 | Simon | |
| 2016/0113388 | A1 | 4/2016 | Distefano | |
| 2016/0143406 | A1 | 5/2016 | Collins et al. | |
| 2017/0071302 | A1 | 3/2017 | Mckelvey | |
| 2018/0116353 | A1 | 5/2018 | Howell | |
| 2018/0271310 | A1 | 9/2018 | Klugh et al. | |
| 2018/0289127 | A1 | 10/2018 | Mckelvy | |
| 2020/0077761 | A1 | 3/2020 | Mckelvey | |
| 2020/0187611 | A1 | 6/2020 | Mckelvey et al. | |
| 2020/0352298 | A1 | 11/2020 | Ruyter | |
| 2021/0037935 | A1 | 2/2021 | Tieu | |
| 2021/0251359 | A1 | 8/2021 | Li et al. | |
| 2021/0310163 | A1 | 10/2021 | Newson | |
| 2021/0393007 | A1 * | 12/2021 | Rodriguez | A45C 7/0045 |

FOREIGN PATENT DOCUMENTS

| | | |
|---|---|---|
| CA | 2081301 | 4/1994 |
| CA | 2871810 | 5/2016 |
| CA | 2936342 | 1/2018 |
| CN | 204812504 | 12/2015 |
| EP | 2490957 | 8/2012 |
| WO | 2007019379 | 2/2007 |

* cited by examiner

LUGGAGE SYSTEM WITH CLOTHING RACK AND METHOD OF USE

CROSS-REFERENCE TO RELATED APPLICATION

This application is a continuation-in-part of and claims priority in U.S. patent application Ser. No. 17/537,915, filed Nov. 30, 2021, which claims priority in U.S. Provisional Patent Application No. 63/119,415 Filed Nov. 30, 2020, all of which are incorporated herein by reference.

BACKGROUND OF THE INVENTION

1. Field of the Invention

The present invention relates generally to a luggage system and method for use thereof, and more specifically to a rigid luggage system with telescoping posts for a clothes-hanging rack and containment system thereof.

2. Description of the Related Art

Dancers, performers, travelers, or anyone else often need to quickly change clothing or costumes in public places. Typical luggage requires the user to sift through piles of clothing to find the correct article. Existing luggage with wardrobe attachments require the wardrobe bar to extend from the storage compartment of the luggage, rendering the luggage unable to close while the wardrobe feature is in use. Further, these wardrobe features are typically made to be as lightweight and cheaply as possible, typically having a single structural post extending away from the luggage on either side of the crossbar. While the luggage is open, contents stored within are susceptible to theft.

BRIEF SUMMARY OF THE INVENTION

The present invention generally provides a rigid piece of luggage with a pair of telescoping posts which suspend a clothing rack above the luggage. This allows the user to place wardrobe changes in an organized and ready-to-wear orientation for dance competitions, plays, or other events where the user needs quick access to clothing. This could also be used for regular travel for hanging clothes directly from the user's luggage.

The telescoping pole is installed within cavity receivers within the luggage and which then can be telescoped upward to suspend the clothing rack. A cover can seal the receiver when not in use. A button on the inside of the luggage can be depressed to release the telescoping arms.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Luggage System 2 With Suspended Clothing Rack 26

Figure 1:
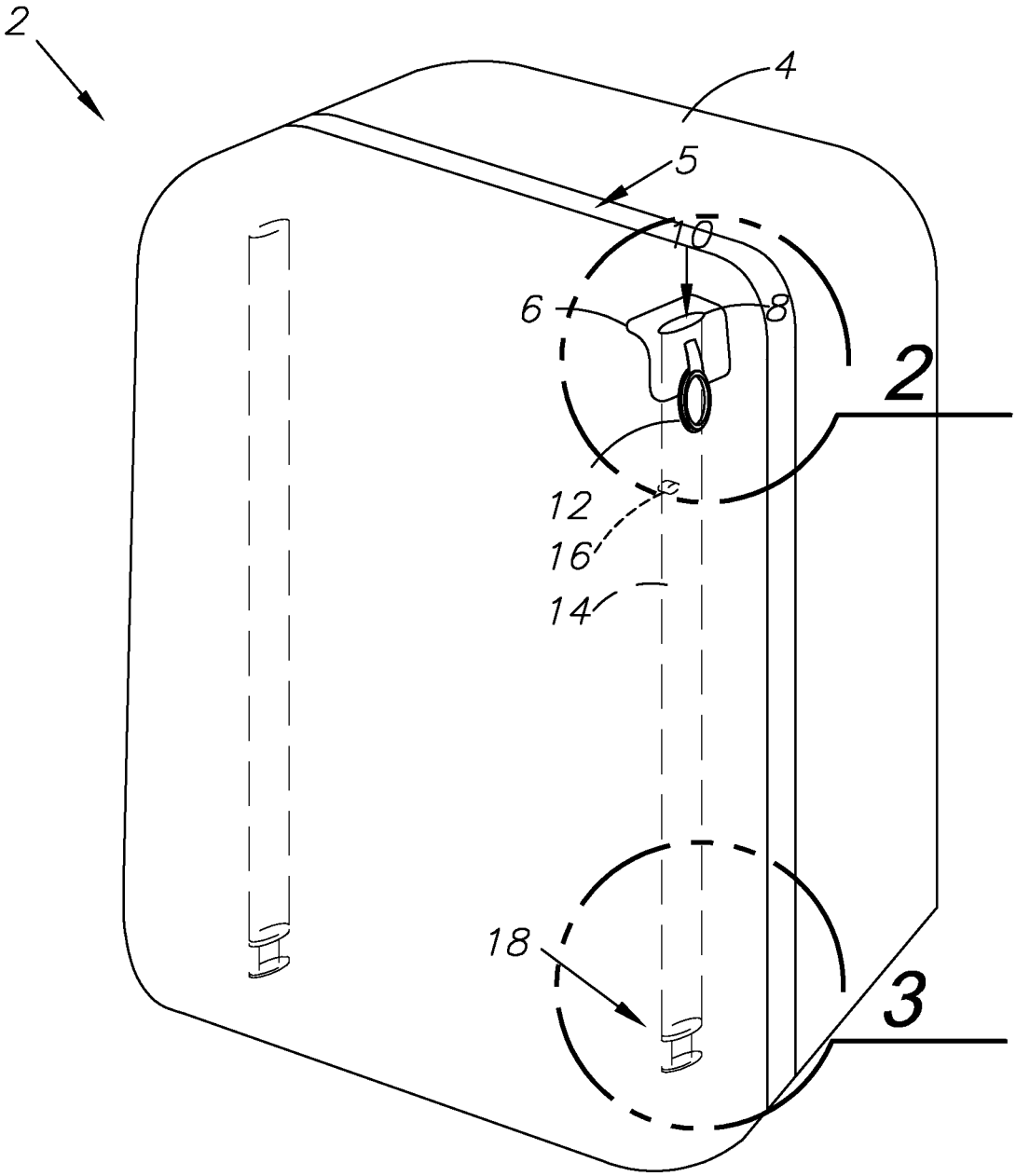
FIG. 1 is a three-dimensional view of a preferred embodiment of the present invention shown in a first, stored orientation.
Figure 2:
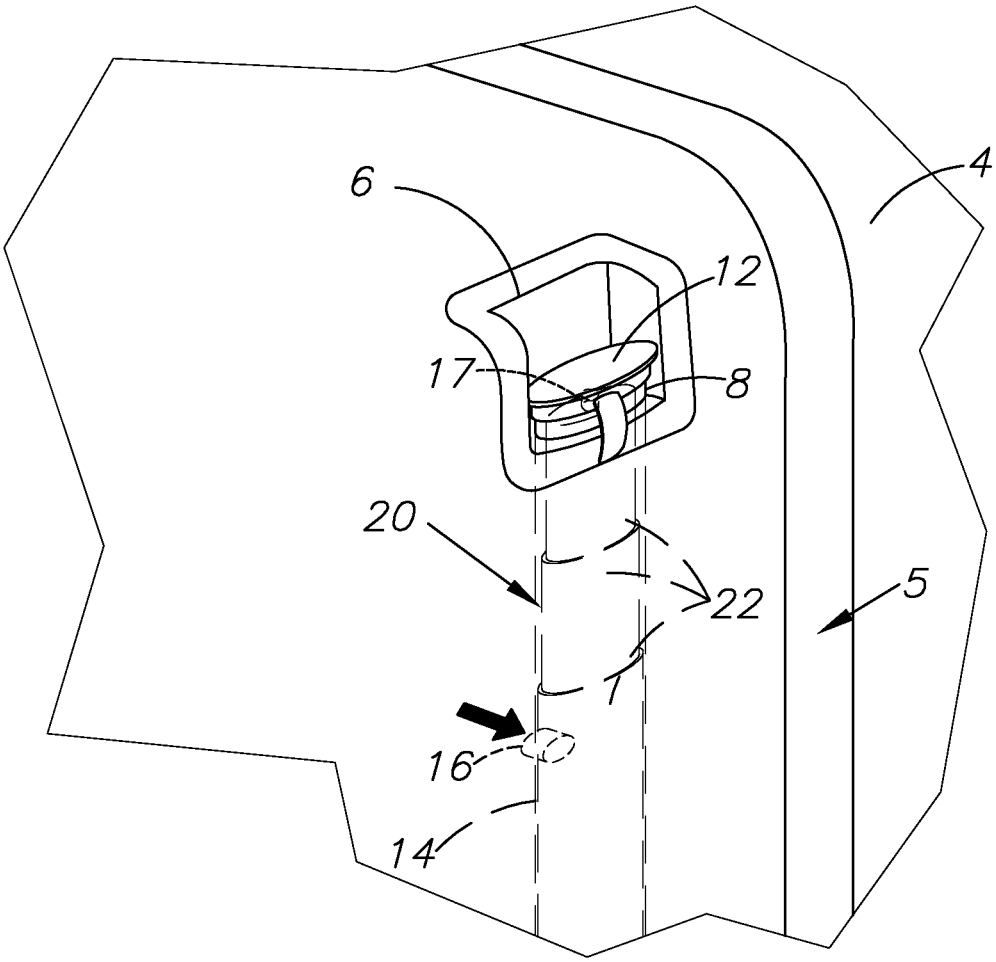
FIG. 2 is a detailed view taken about the circle of FIG. 1.
Figure 3:
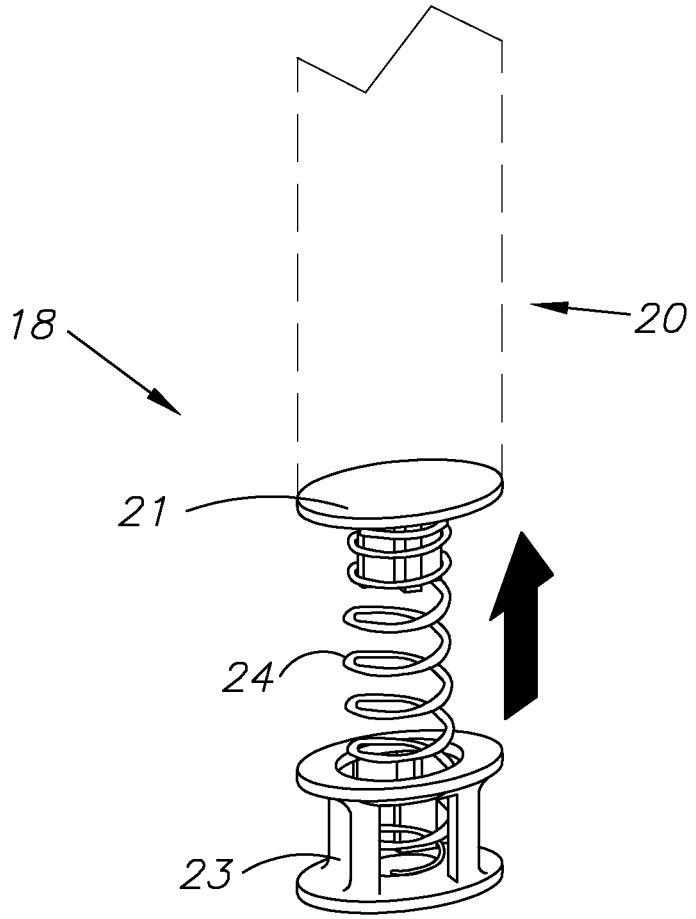
FIG. 3 is a detailed view taken about the circle of FIG. 1.
Figure 4:
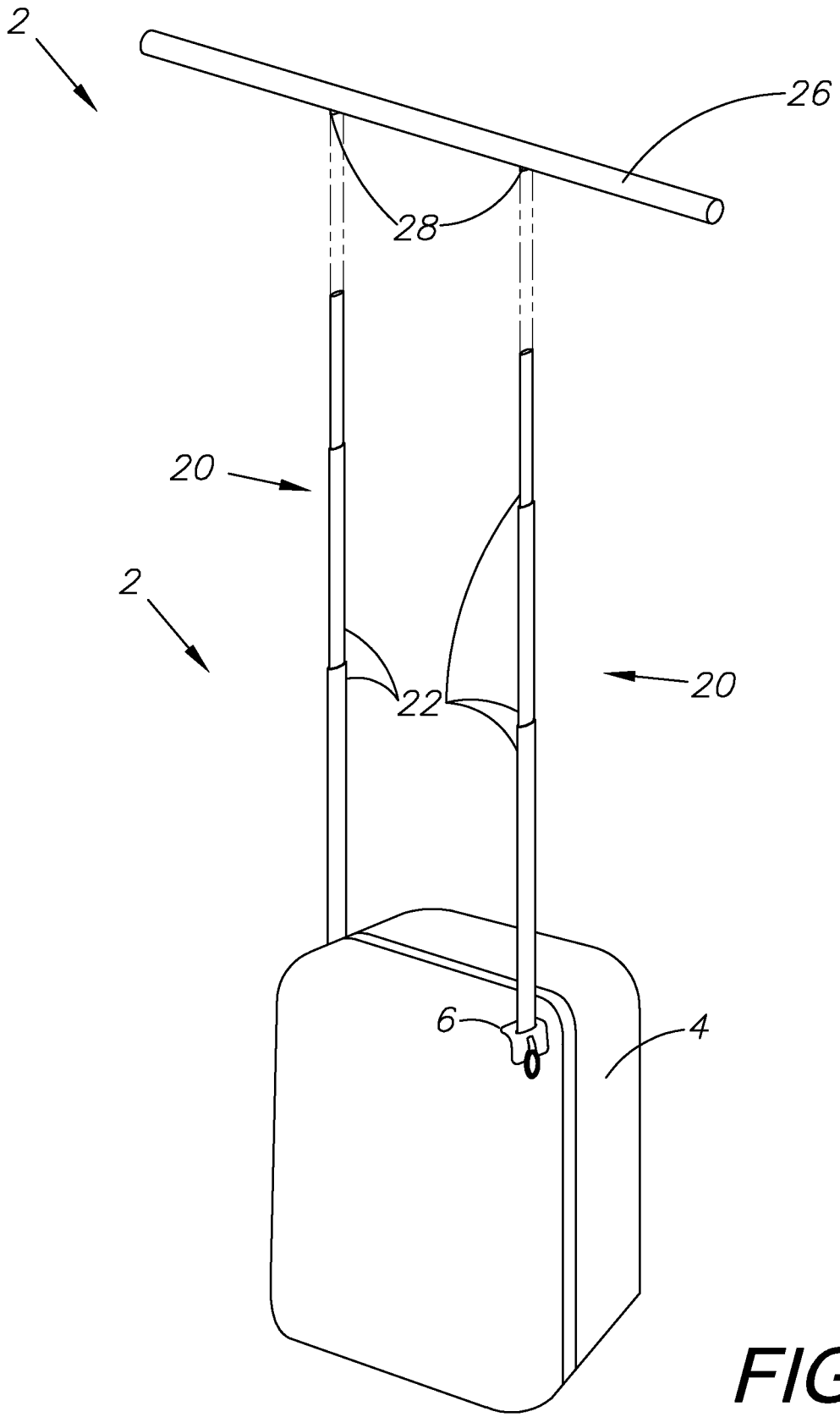
FIG. 4 is a partially exploded three-dimensional view of the embodiment of FIG. 1 shown in a second, extended orientation.

As shown in FIGS. 1-6, the present invention provides a piece of luggage 2 with a pair of receiver cavities 14 each terminating in a receiver cap 6. Each cavity can receive one telescoping arm 20, made of a number of interlocking segments 22, which is inserted into engaged with a respective receiver. The arms can telescope upward, as shown in FIG. 4, to suspend a clothing rack 26 above the luggage. Clothing can be hung from the rack with or without hangers.

As shown in FIG. 2, the receiver cap 6 can have a cover 12 for closing the top opening 8 of the receiver cavity 14. The receiver cavity 14 is accessible has a hollow interior 10 housing the telescoping arm when in a first, stored orientation. The cover 12 could be closed with or without the telescoping arm inserted into the receiver. A button 16 or other release mechanism can be used to release the telescoping arm from within the receiver. As shown, the user would open the luggage case 4 via the opening 5 and access the button 16 on the interior of the luggage case 4. Once done, this would activate a spring element 18 at the base of the receiver cavity 14 as shown in more detail in FIG. 3.

When the button 16 is pressed, the spring element 18 pushes the telescoping arm 20 upwards out of the top opening 8 such that the user can then telescope the arms 20 upwards, the individual sections 22 locking into their respective places. An embodiment could include an automatically telescoping arm using multiple such spring elements. When the arms 20 are pressed back within the receiver cavities 14 fully, returning the luggage system 2 to a first, stored orientation, the button 16 will lock the arms 20 into place, with the spring element 18 locked in a ready position.

Alternatively, as shown in FIG. 2, a button 17 may be located at the top of the telescoping arm 20. When this button 17 is pressed, the spring element 18 again would unlock, pushing the arm up and out of the receiver cavities 14. When pushed back down, the spring element 18 would then lock in place.

The spring element 18 as shown in FIG. 3 has a base 23 which is set against the bottom of the receiver cavity 14. A spring 24 connects the base to a top platform 21 which is set against the bottom edge of the bottom-most arm 20 segment 22. When pressed down and locked into place via the button 16, the arm 20 will keep the spring 23 depressed and ready to push the arm 20 upwards when the button 17 is depressed.

The clothing rack 26 may be inserted onto the tops of the arms 20 using rack receivers 28 which connect to the top ends of the upper-most arm 20 segments 22. Alternatively, the arms 20 may have folding elements which can form the clothing rack, or some other suitable means of retaining a clothing rack about the tops of the arms 20 could be employed. For added, on-the-go privacy, a curtain (not shown) could be added to the clothing rack 26 for a fast-changing room.

Figure 5:
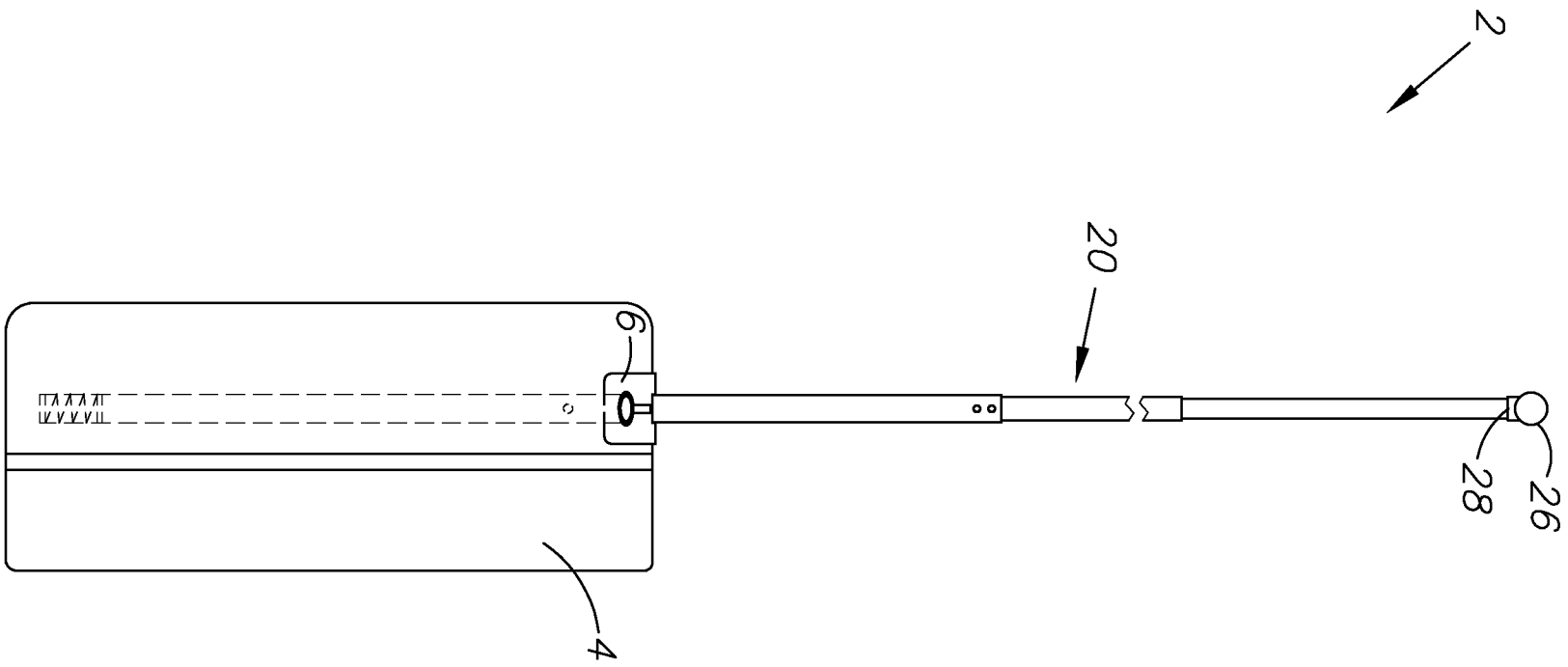
FIG. 5 is a side elevational view thereof.
Figure 6:
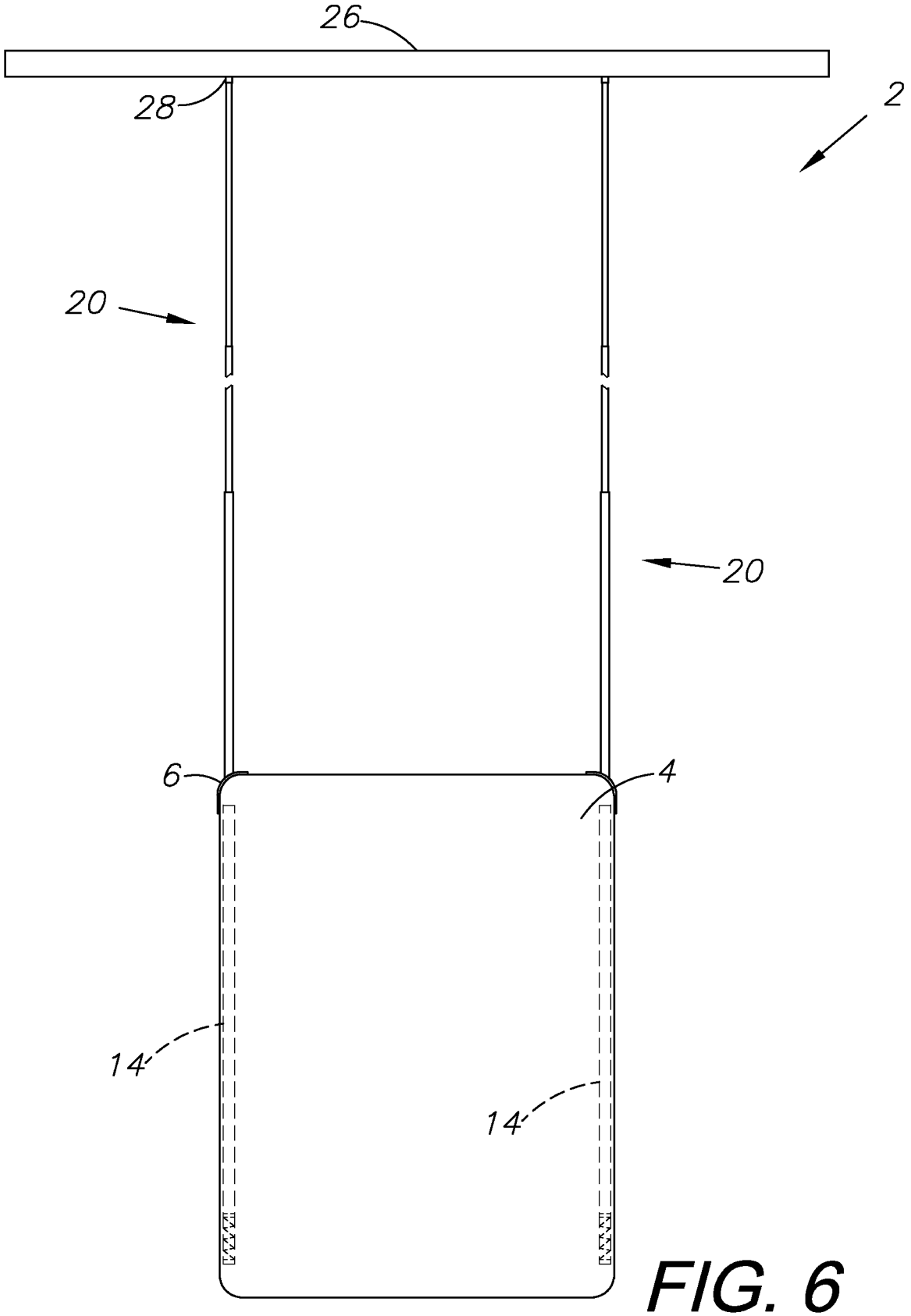
FIG. 6 is a front elevational view thereof.
Figure 7:
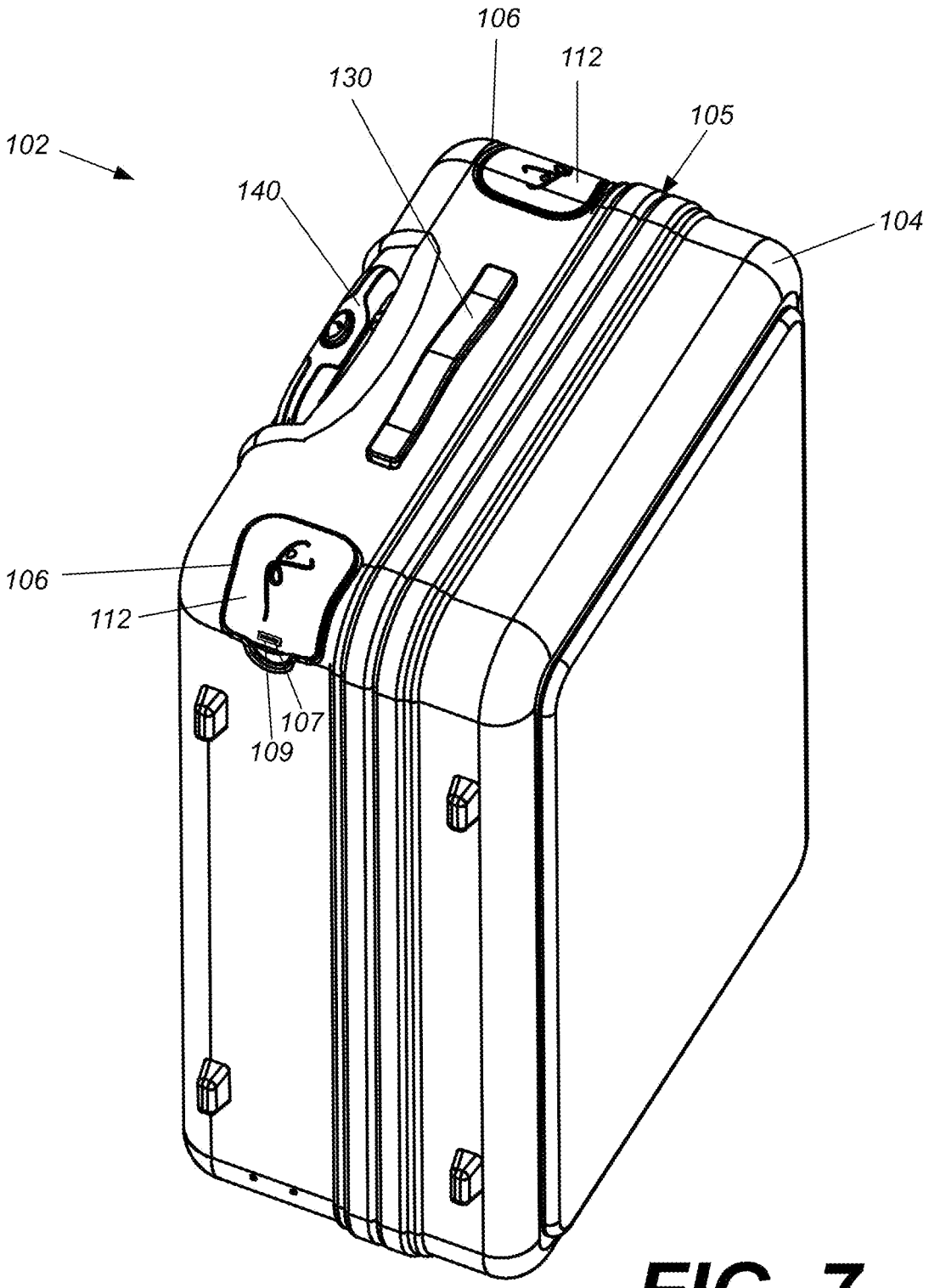
FIG. 7 is a three-dimensional isometric view of an alternative embodiment of the present invention shown in a closed orientation.

In an alternative embodiment, the spring element 18 could be a spring-loaded pop-up button rather than relying on the internal button 16. The spring element 18 can have two orientations: a first, locked orientation where the telescoping arm 20 is locked down within the receiver cavity 14, and a second, popped-up orientation where the telescoping arm 20 is pressed downwardly against the spring element 18, thereby unlocking the spring element 18 and popping the arm 20 up out of the top opening 8 of the receiver cavity 14. When pressed again, the spring element 18 would lock back down with the telescoping arm secured within the cavity. When the telescoping arm is pulled out of the cavity, the various segments 22 lock into place as shown in FIGS. 4-6.

III. Alternative Embodiment Luggage System 102 with Suspended Clothing Rack 126

FIGS. 7-11 show an alternative embodiment luggage system 102. Like a typical piece of luggage, this embodiment includes an opening 105 which is secured via a zipper or other suitable closure, a handle strap 130 affixed to at least one side of the luggage body 104, and a telescoping handle 140, designed to extend out and away from the luggage body 104 to allow the luggage to be pulled along the ground by pulling on the telescoping handle. This telescoping handle may be any suitable telescoping handle commonly employed in luggage systems, such as the luggage sold by the Away company of New York or any other common luggage retailer.

This embodiment functions largely the same as the previous embodiment, with key improvements.

Figure 8:
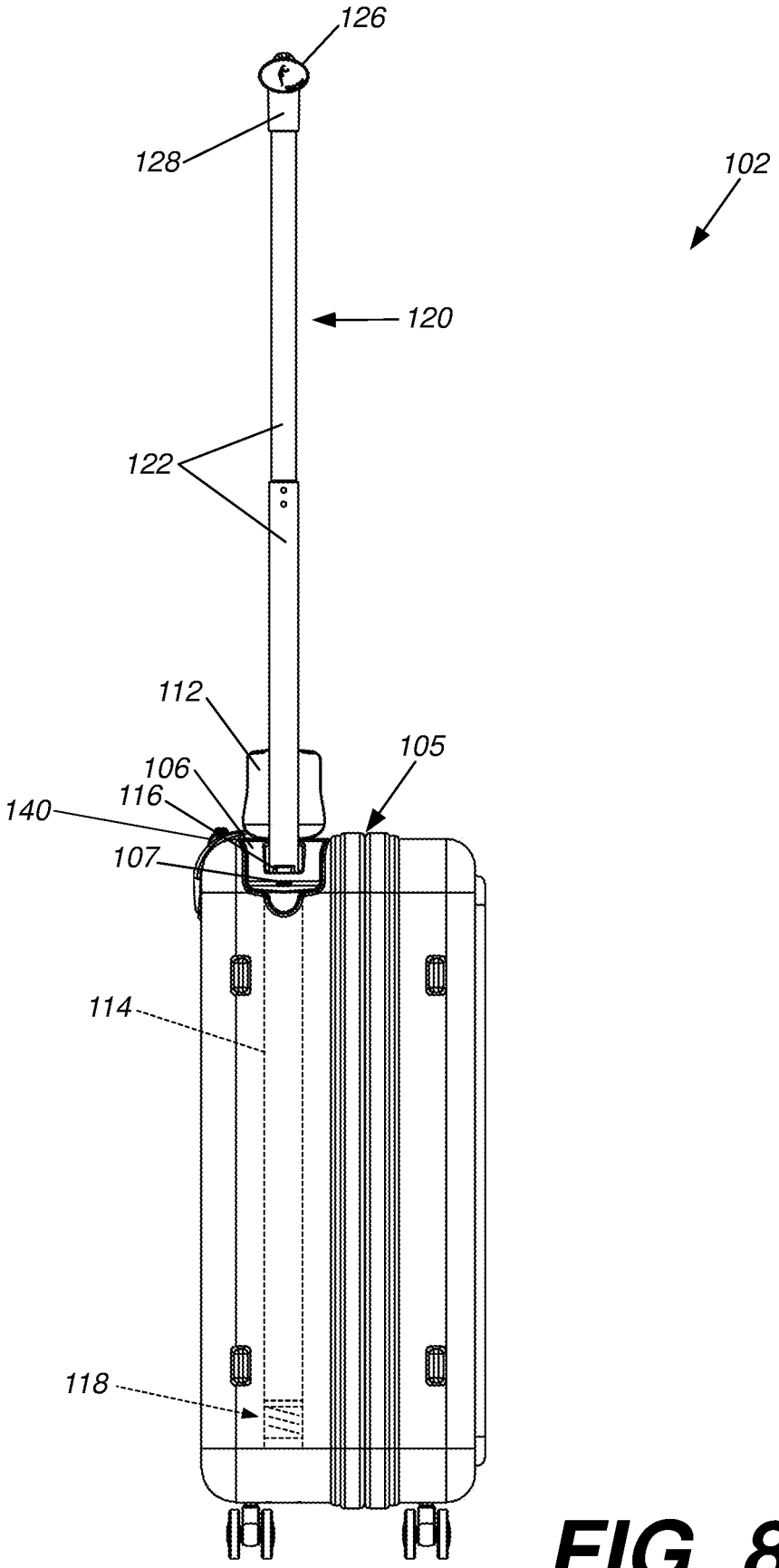
FIG. 8 is a side elevational view thereof, shown in an open orientation.

As shown in FIG. 8, the invention provides the piece luggage system 102 with a pair of receiver cavities 114 each terminating in a receiver cap 106. Each cavity can receive one telescoping arm 120, made of a number of interlocking segments 122, which is inserted into engaged with a respective receiver. The arms can telescope upward, as shown in FIG. 8, to suspend a clothing rack 126 above the luggage. Clothing can be hung from the rack with or without hangers. The clothing rack 126 can be connected to the telescoping arms 120 via a pair of rack receivers 128, which could simply be holes or connectors within the body of the clothing rack 126, or may extend away from the clothing rack to receive the arms 120.

Figure 9:
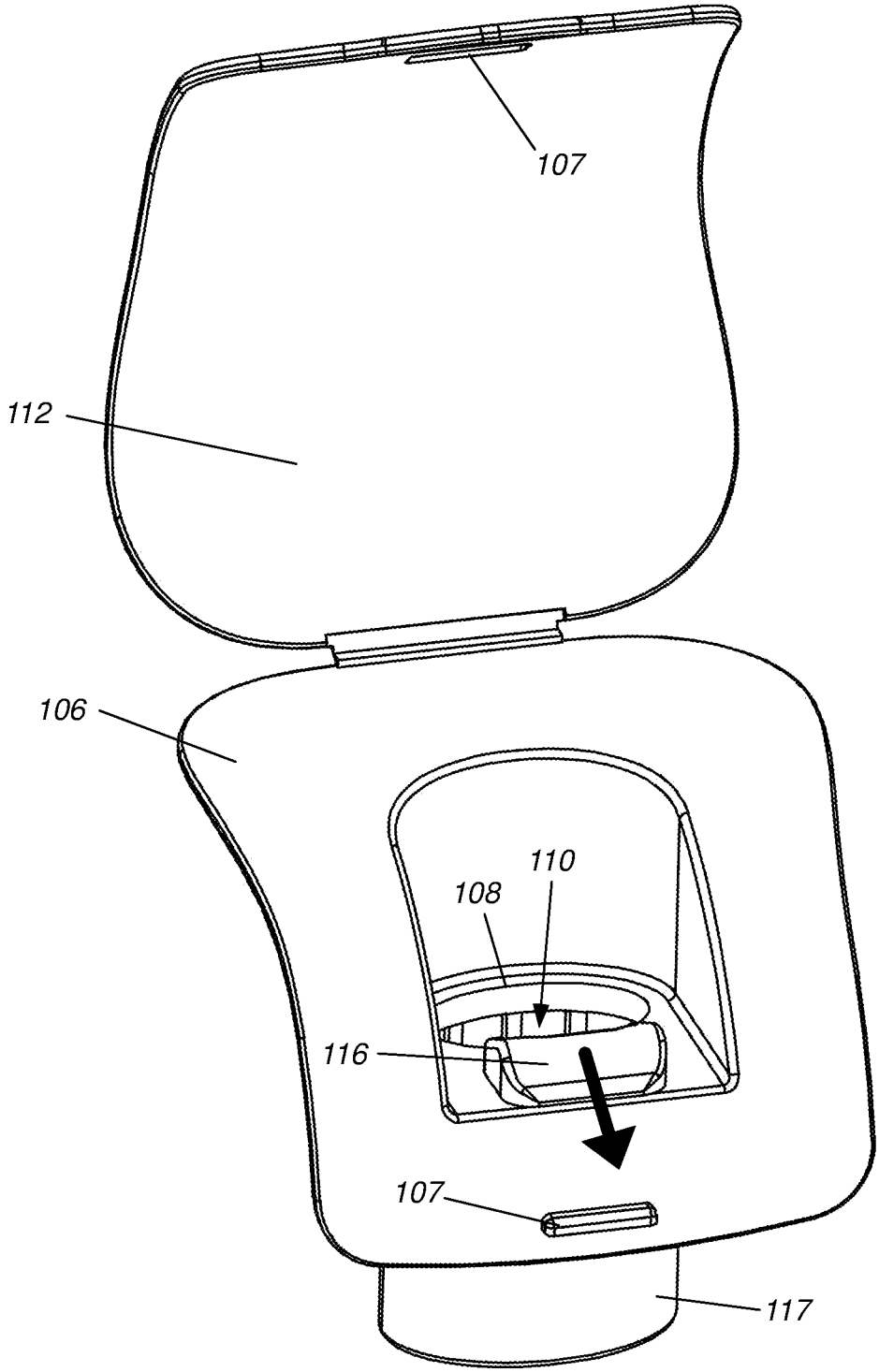
FIG. 9 is a detailed three-dimensional isometric view of an alternative embodiment receiver cap element thereof shown in an open orientation separate from the remaining luggage.
Figure 10:
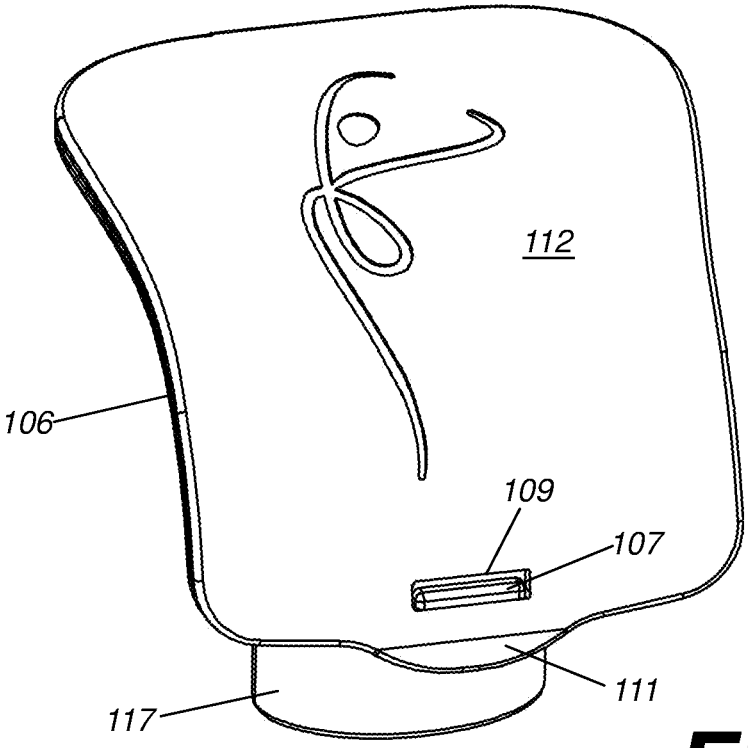
FIG. 10 is a detailed three-dimensional isometric view thereof shown in a closed orientation.
Figure 11:
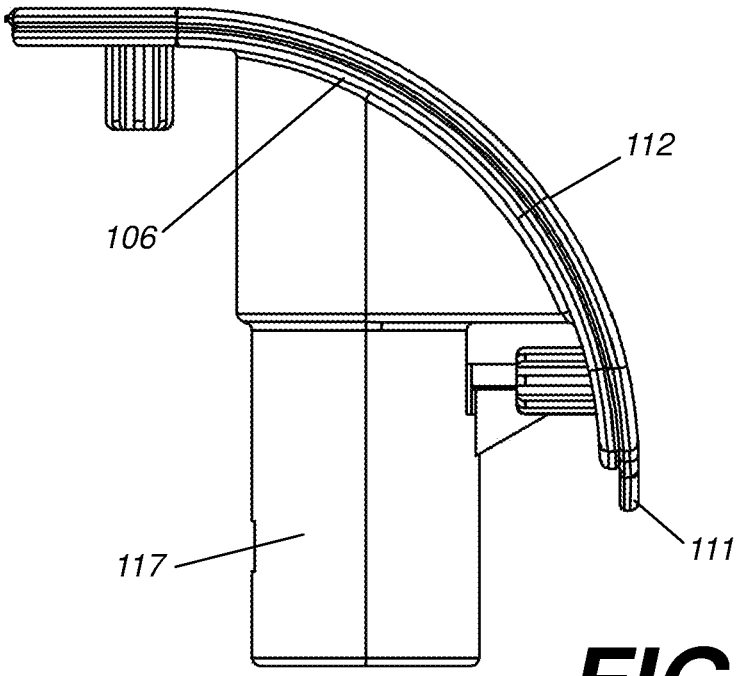
FIG. 11 is a side elevational view thereof.

As shown in FIG. 9, the receiver cap 106 can have a cover 112 for closing the top opening 108 of the receiver cavity 114. The receiver cavity 114 is accessible has a hollow interior 110 housing the telescoping arm when in a first, stored orientation. The cover 112 could be closed with or without the telescoping arm inserted into the receiver. A slidable latch 116 or other release mechanism can be used to release the telescoping arm from within the receiver. A static latch 109 can receive a latch receiver 107 located within the cover 112. FIG. 10 shows this in more detail. The cover 112 may have a lifting lip 111 to help in opening the cover. The receiver cap 106 has a stem 117 which is inserted into the receiver cavity 114.

As shown, the user would flip open the cover 112 of the receiver cap 106. From there, the user would pull on the slidable latch 116, which would release the telescoping arms 120 by a spring element 118, which functions identically to the spring element of the previous embodiment. The slidable latch 116 could be spring loaded, such that it slides back into place, and would reengage and lock the telescoping arms 120 when they are reinserted into the opening 108 of the receiver cap 106. There is no need to access the interior opening 105 of the luggage 102 in this embodiment.

IV. Alternative Embodiment Luggage System 202

Figure 12:
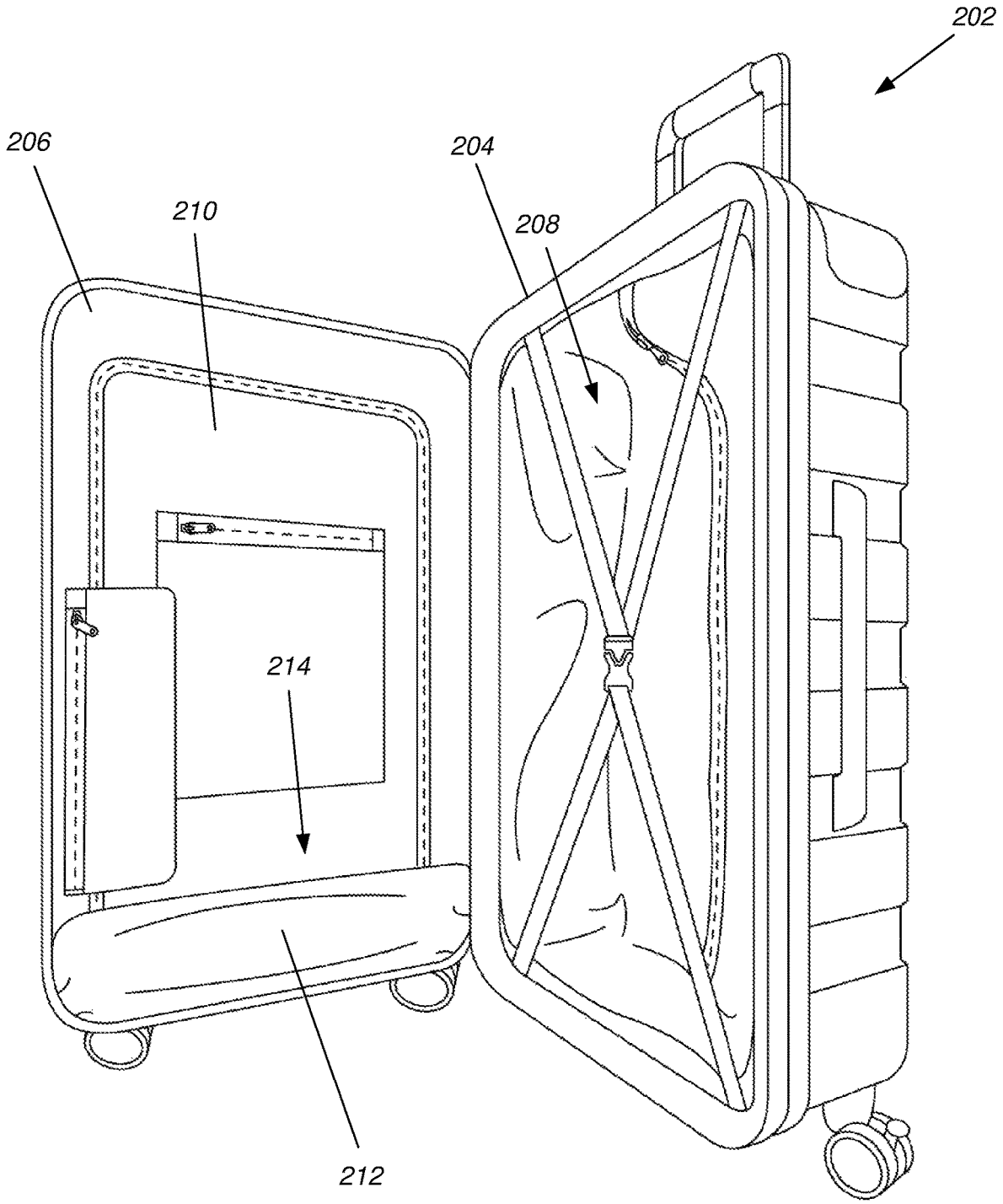
FIG. 12 is a three-dimensional isometric view of an alternative embodiment luggage system with a weighted element.
Figure 13:
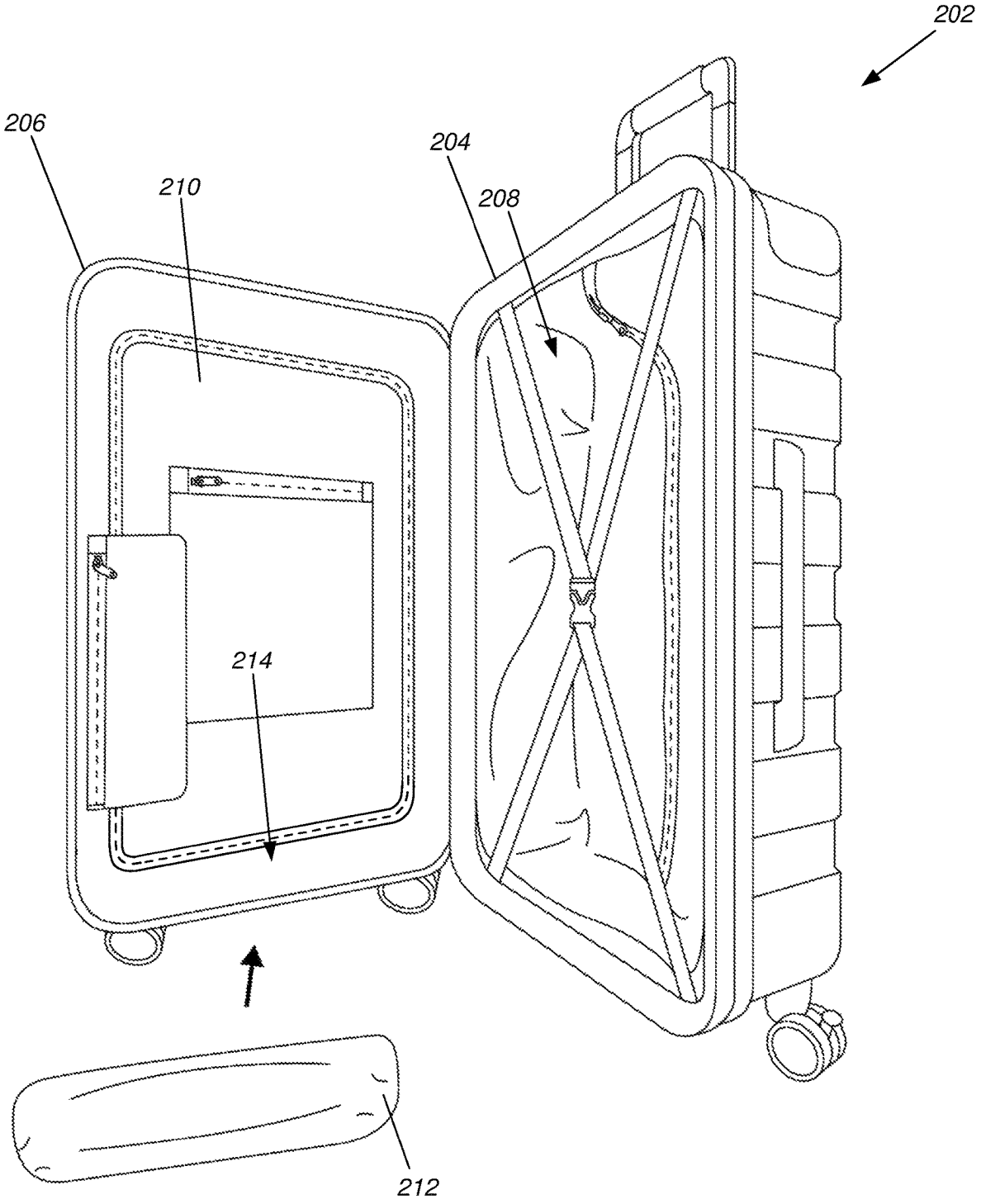
FIG. 13 is a three-dimensional isometric view thereof showing the weighted element being removed.
Figure 14:
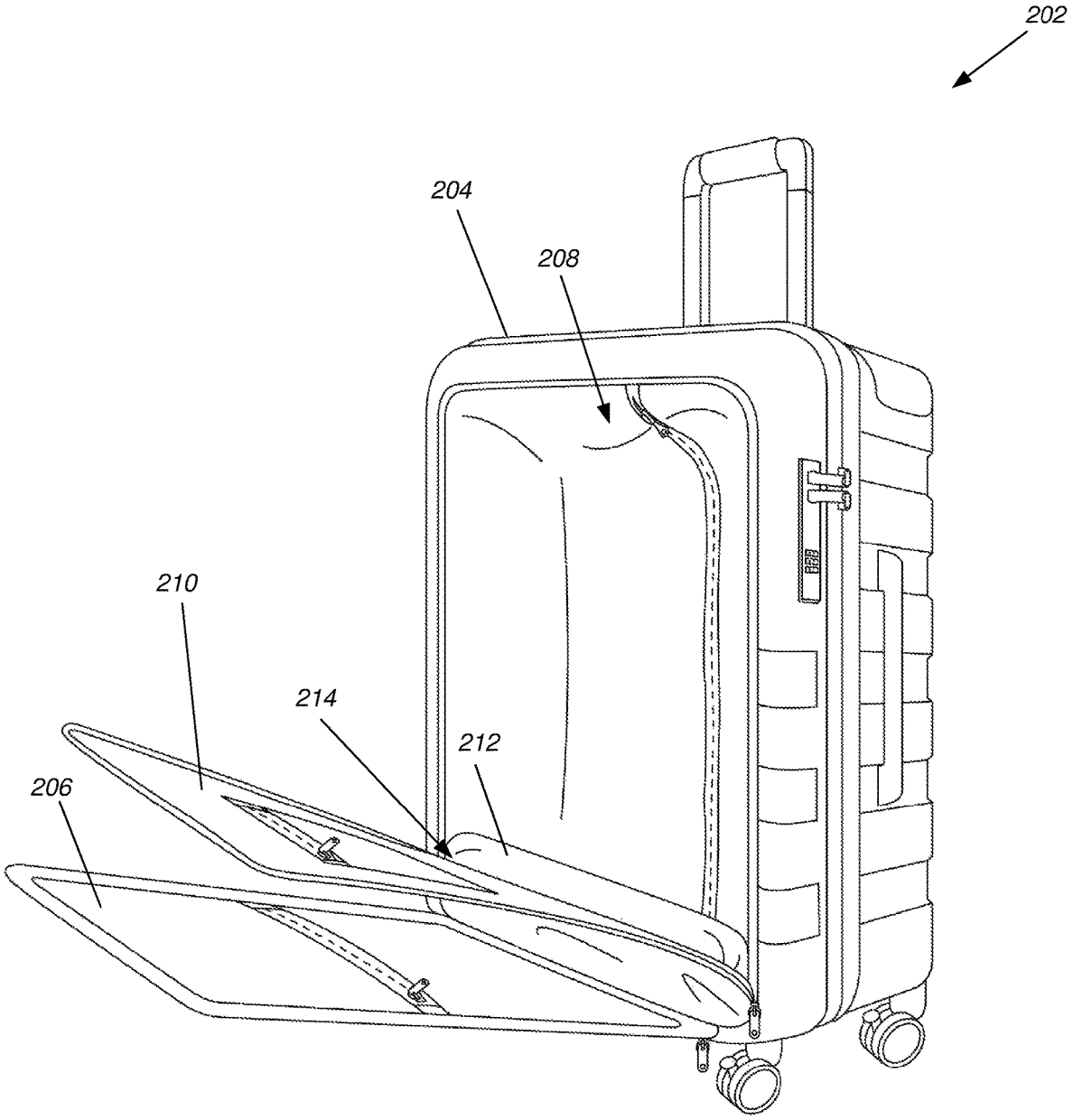
FIG. 14 is a three-dimensional isometric view thereof showing an alternative arrangement of the embodiment thereof.

FIGS. 12-14 show another alternative luggage system 202 which could incorporate the elements of the prior embodiments 2, 102. This alternative luggage system 202 has a furniture body 204 and an openable door 206 which combined surround an interior space 208. An optional zip-out opening 210 may be included. A weighted element 212 is stored within the interior space 208, either in the door space 214 or within the main body of the luggage system 202. FIG. 13 shows how the weighted element 212 is removed. FIG. 14 shows how the zipperable opening 210 and door 206 may open in an alternative orientation, exposing the interior space 208 and the weighted element 212.

The weighted element 212 acts as a counterweight to the luggage system 202 when it is deployed in a deployed orientation with extended arms and rods as included in the other embodiments.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A luggage system for a rigid piece of luggage having an exterior face and an interior compartment, the luggage further including a telescoping handle comprising telescoping handle arms configured for pulling said luggage, the luggage system further comprising:

a pair of receiver cavities having a floor near a bottom of the piece of luggage and a top opening near a top of said piece of luggage;

a pair of telescoping arms, each one of said pair of telescoping arms being deployed within a respective one of said pair of receiver cavities;

each of said pair of receiver cavities including a selectively releasable slidable latch configured to retain the respective one of said pair of telescoping arms within the respective one of said receiver cavities;

each said selectively releasable slidable latch configured to release the respective one of said pair of telescoping arms from within the respective one of said pair of receiver cavities such that each said arm can be telescoped upward, thereby transforming said luggage system from said first, stored orientation and said second, deployed orientation;

each said slidable latch being accessible upon lifting a cap;

said slidable latch being spring loaded, such that said latch is configured to return to its original orientation when released;

thereby said slidable latch configured to automatically engage and secure its respective said telescoping arm upon replacement of said telescoping arm into its respective receiver cavity;

each of said pair of receiver cavities including a spring element deployed between said floor of the respective one of said pair of receiver cavities and a bottom end of the respective one of said pair of telescoping arms;

wherein said luggage system is configured to be transformed between a first, stored orientation and a second, deployed orientation;

each respective one of said pair of telescoping arms configured to be released from within the respective one of said pair of receiver cavities, thereby transforming said luggage system from said first, stored orientation and said second, deployed orientation; and a clothing rack configured to be connected to a top end of each of said pair of telescoping arms when said luggage system is transformed into said second, deployed orientation.

2. The luggage system of claim 1, further comprising:

each said cap comprising a stem configured to be inserted into said receiver cavity.

3. The luggage system of claim 1, further comprising:

each said cap comprising a latch; and each said cover comprising a latch receiver configured to receive said latch when in a closed orientation.

4. The luggage system of claim 1, further comprising:

each said spring element having a first, locked position and a second, unlocked position;

each said spring element configured to be transformed from said first, locked position to said second, unlocked position by pressing downward against the respective one of said pair of telescoping arms located above the respective said spring element;

each said spring element thereby configured to release the respective one of said pair of telescoping arms from within the respective one of said pair of receiver cavities, thereby transforming said luggage system from said first, stored orientation and said second, deployed orientation; and each said spring element configured to be transformed from said second, unlocked position to said first, locked position by pressing downward against the respective one of said pair of telescoping arms located above the respective said spring element a second time.

5. The luggage system of claim 1, further comprising at least two roller wheels configured to allow the piece of luggage to be rolled.

6. The luggage system of claim 1, further comprising at least one exterior storage compartment located on an exterior face of the said piece of luggage.

7. The luggage system of claim 1, further comprising:

a removable weight element configured to be moved from a first, stored orientation located within the interior compartment of said piece of luggage to a second, removed orientation where it is selectively removed from said interior compartment; and said removable weight element configured to act as a counterweight against said clothing rack when said removable weight is placed in said first, stored orientation and when said luggage system is positioned in said second, deployed orientation.

8. A luggage system for a rigid piece of luggage having an exterior face and an interior compartment, the luggage further including a telescoping handle comprising telescoping handle arms configured for pulling said luggage, the luggage system further comprising:

a pair of telescoping arms being deployed within said piece of luggage;

wherein said luggage system is configured to be transformed between a first, stored orientation and a second, deployed orientation;

each respective one of said pair of telescoping arms configured to be released from within the respective one of said pair of receiver cavities, thereby transforming said luggage system from said first, stored orientation and said second, deployed orientation;

a clothing rack configured to be connected to a top end of each of said pair of telescoping arms when said luggage system is transformed into said second, deployed orientation;

a removable weight element configured to be moved from a first, stored orientation located within the interior compartment of said piece of luggage to a second, removed orientation where it is selectively removed from said interior compartment; and said removable weight element configured to act as a counterweight against said clothing rack when said removable weight is placed in said first, stored orientation and when said luggage system is positioned in said second, deployed orientation.

9. The luggage system of claim 1, wherein the piece of luggage comprises a rigid shell.

10. A luggage system for a rigid piece of luggage having an exterior face and an interior compartment, the luggage further including a telescoping handle comprising telescoping handle arms configured for pulling said luggage, the luggage system further comprising:

a pair of receiver cavities having a floor near a bottom of the piece of luggage and a top opening near a top of said piece of luggage;

a pair of telescoping arms, each one of said pair of telescoping arms being deployed within a respective one of said pair of receiver cavities;

each of said pair of receiver cavities including a selectively releasable securing element configured to retain the respective one of said pair of telescoping arms within the respective one of said receiver cavities;

each said selectively releasable securing element configured to release the respective one of said pair of telescoping arms from within the respective one of said pair of receiver cavities such that each said arm can be telescoped upward, thereby transforming said luggage system from said first, stored orientation and said second, deployed orientation;

each of said pair of receiver cavities including a spring element deployed between said floor of the respective one of said pair of receiver cavities and a bottom end of the respective one of said pair of telescoping arms;

wherein said luggage system is configured to be transformed between a first, stored orientation and a second, deployed orientation;

each respective one of said pair of telescoping arms configured to be released from within the respective one of said pair of receiver cavities, thereby transforming said luggage system from said first, stored orientation and said second, deployed orientation;

a clothing rack configured to be connected to a top end of each of said pair of telescoping arms when said luggage system is transformed into said second, deployed orientation;

a removable weight element configured to be moved from a first, stored orientation located within the interior compartment of said piece of luggage to a second, removed orientation where it is selectively removed from said interior compartment; and said removable weight element configured to act as a counterweight against said clothing rack when said removable weight is placed in said first, stored orientation and when said luggage system is positioned in said second, deployed orientation.

* * * * *